US007850233B2

(12) United States Patent
Shafer et al.

(10) Patent No.: US 7,850,233 B2
(45) Date of Patent: Dec. 14, 2010

(54) ERGONOMIC CARRY HANDLE FOR JUVENILE VEHICLE SEAT

(75) Inventors: Ryan Shafer, Uxbridge, MA (US); David Amirault, Easton, MA (US)

(73) Assignee: Cosco Management, Inc., Wilmington, DE (US)

( * ) Notice: Subject to any disclaimer, the term of this patent is extended or adjusted under 35 U.S.C. 154(b) by 305 days.

(21) Appl. No.: 12/197,873

(22) Filed: Aug. 25, 2008

(65) Prior Publication Data

US 2009/0058153 A1 Mar. 5, 2009

Related U.S. Application Data

(60) Provisional application No. 60/970,171, filed on Sep. 5, 2007.

(51) Int. Cl.
*A47D 1/10* (2006.01)

(52) U.S. Cl. ..... 297/183.3; 297/183.1; 297/183.2; 297/183.4; 297/183.6; 297/250.1; D6/333

(58) Field of Classification Search ..... 297/183.1, 297/183.2, 183.3, 183.4, 183.6, 250.1; D6/333, D6/356

See application file for complete search history.

(56) References Cited

U.S. PATENT DOCUMENTS

| | | | | |
|---|---|---|---|---|
| 5,544,935 | A | 8/1996 | Cone, II et al. | |
| D379,888 | S | 6/1997 | Cone, II et al. | |
| 5,658,044 | A * | 8/1997 | Krevh | 297/183.6 |
| D429,075 | S | 8/2000 | Cone, II | |
| D451,312 | S | 12/2001 | Kain | |
| D451,713 | S | 12/2001 | Kain | |
| D451,714 | S | 12/2001 | Cone, II | |
| 6,428,100 | B1 | 8/2002 | Kain et al. | |
| 6,626,489 | B2 * | 9/2003 | Geis et al. | 297/183.1 |
| 6,715,828 | B1 * | 4/2004 | Cheng | 297/183.3 |
| 6,893,040 | B2 * | 5/2005 | Hou et al. | 297/183.2 X |
| 7,270,372 | B2 * | 9/2007 | Robertson | 297/183.6 |
| 7,488,034 | B2 * | 2/2009 | Ohren et al. | 297/183.6 X |
| 2005/0189797 | A1 * | 9/2005 | Robertson | 297/183.3 |
| 2008/0258516 | A1 * | 10/2008 | Meeker et al. | 297/183.1 |
| 2008/0265633 | A1 * | 10/2008 | Chen et al. | 297/183.6 |

* cited by examiner

*Primary Examiner*—Rodney B White
(74) *Attorney, Agent, or Firm*—Barnes & Thornburg LLP

(57) ABSTRACT

An infant carrier includes a shell and a carry handle coupled to the shell. The carry handle includes first and second side arms coupled to the shell.

22 Claims, 6 Drawing Sheets

ERGONOMIC CARRY HANDLE FOR JUVENILE VEHICLE SEAT

This application claims priority under 35 U.S.C. §119(e) to U.S. Provisional Application Ser. No. 60/970,171, filed Sep. 5, 2007, which is expressly incorporated by reference herein.

BACKGROUND

The present disclosure relates to juvenile vehicle seats, and particularly to infant carriers included in juvenile vehicle seats. More particularly, the present disclosure relates to infant carriers provided with carry handles.

SUMMARY

According to the present disclosure, an infant carrier includes a shell providing a basin sized to hold an infant and a carry handle coupled to the shell. The carry handle includes a hand grip arranged to lie over the basin to facilitate transport of an infant at rest in the basin.

In illustrative embodiments, the carry handle is U-shaped and includes a first side arm mounted on the shell for pivotable movement about an axis, a second side arm mounted on the shell for pivotable movement about the axis and arranged to lie in spaced-apart relation to the first side arm to locate the shell and the basin therebetween, and a bridge rail interconnecting the first and second side arms. The hand grip is coupled to the bridge rail.

In illustrative embodiments, each side arm is formed to include a lower end including a pivot mount appended to the shell, an upper end including a wide bulbous member appended to the bridge rail, and a contoured segment extending between the pivot mount and the bulbous member. Each contoured segment includes a lower section coupled to a companion pivot mount and formed to include an outwardly facing concave surface (e.g., facing away from the basin) defining means for mating with a hip region of a caregiver carrying the shell carrier using the carry handle. The contoured segment also includes a narrow upper section arranged to extend between the lower section and the wide bulbous member in the companion upper end. The narrow upper section includes an inwardly facing (e.g., facing toward the basin) concave surface defining means for mating with an inner portion of an elbow of a caregiver holding the carry handle in the crook of their elbow.

Additional features of the present disclosure will become apparent to those skilled in the art upon consideration of illustrative embodiments exemplifying the best mode of carrying out the disclosure as presently perceived.

DESCRIPTION

Figure 1:
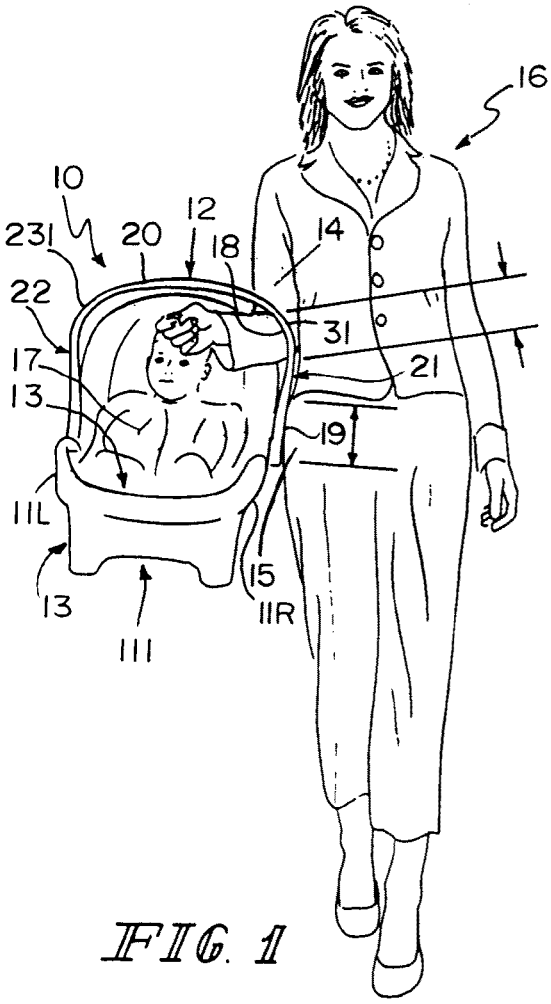
FIG. 1 is a view of an infant carrier in accordance with the present disclosure showing a caregiver holding the carry handle in the crook of her right elbow.
Figure 4:
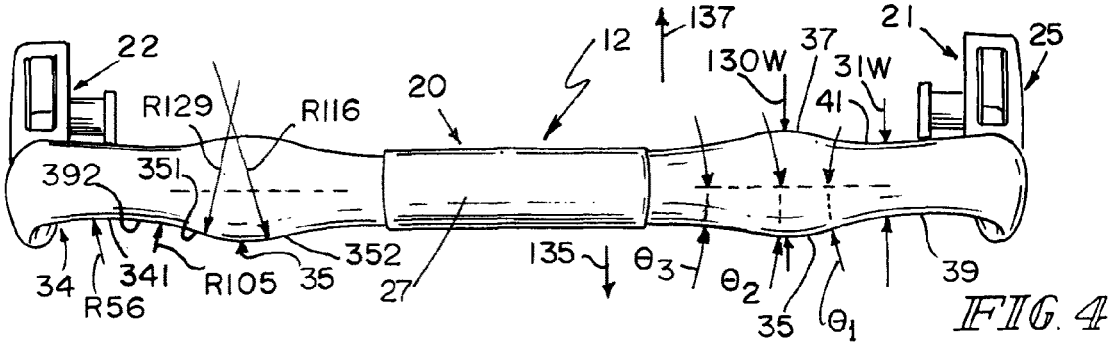
FIG. 4 is a scale top plan view of the carry handle of FIG. 3.
Figure 5:
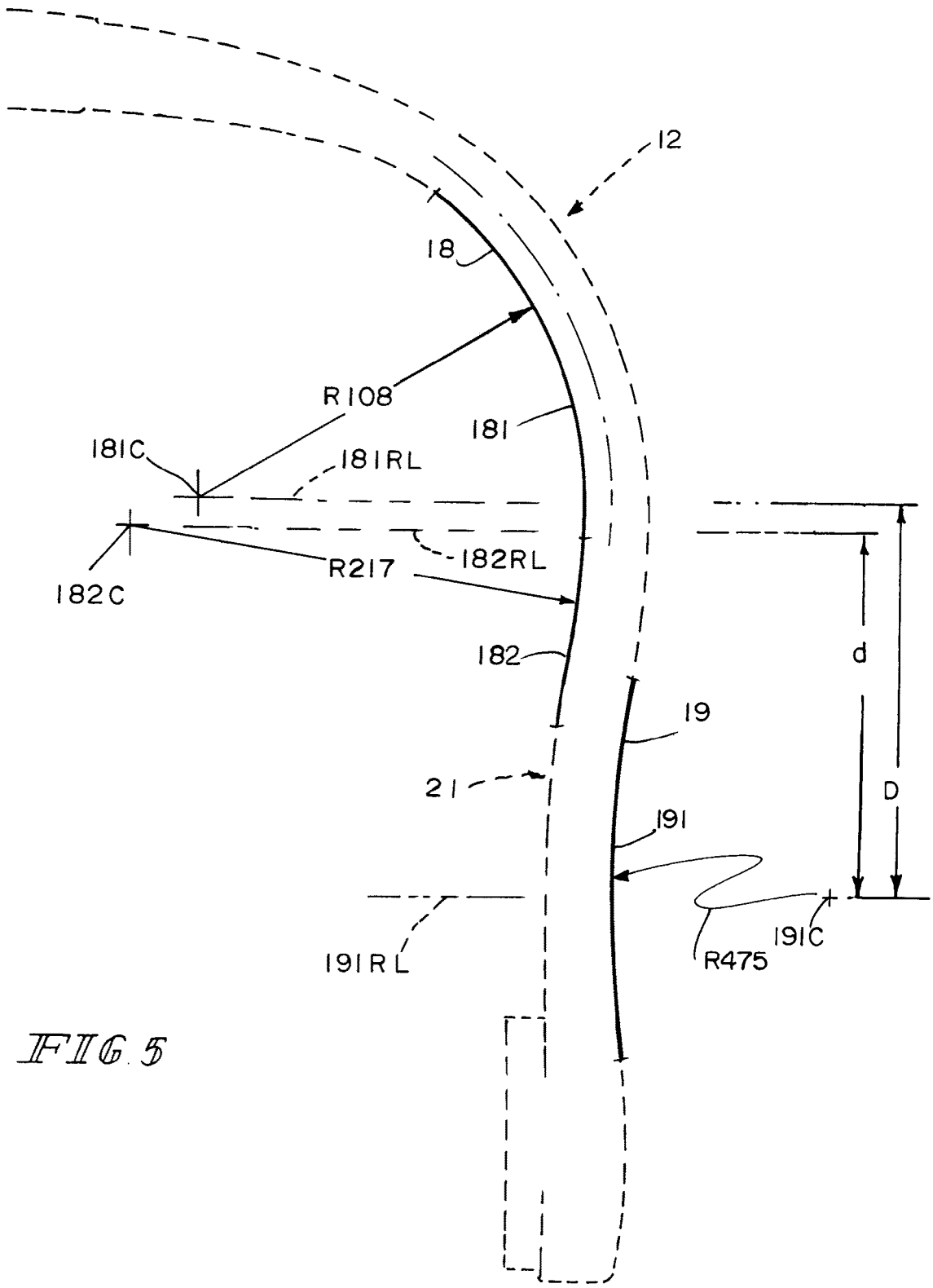
FIG. 5 is a view similar to FIG. 2 showing most of the first side arm in phantom and showing the outwardly and inwardly facing concave surfaces of the contoured section in solid.
Figure 6:
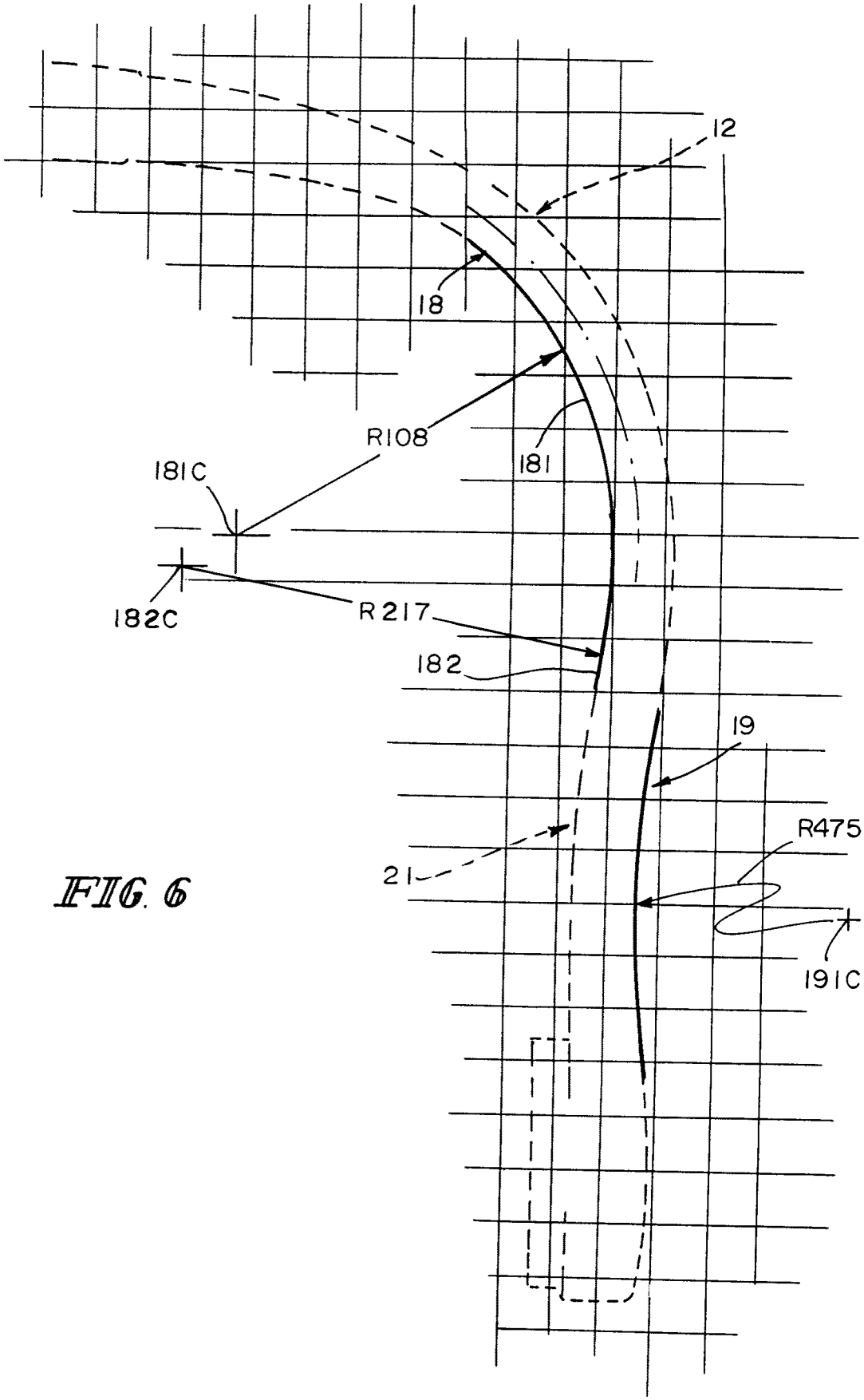
FIG. 6 is a view similar to FIG. 4 on a grid background to illustrate shape characteristics of the outwardly and inwardly facing concave surfaces of the contoured section.
Figure 7:
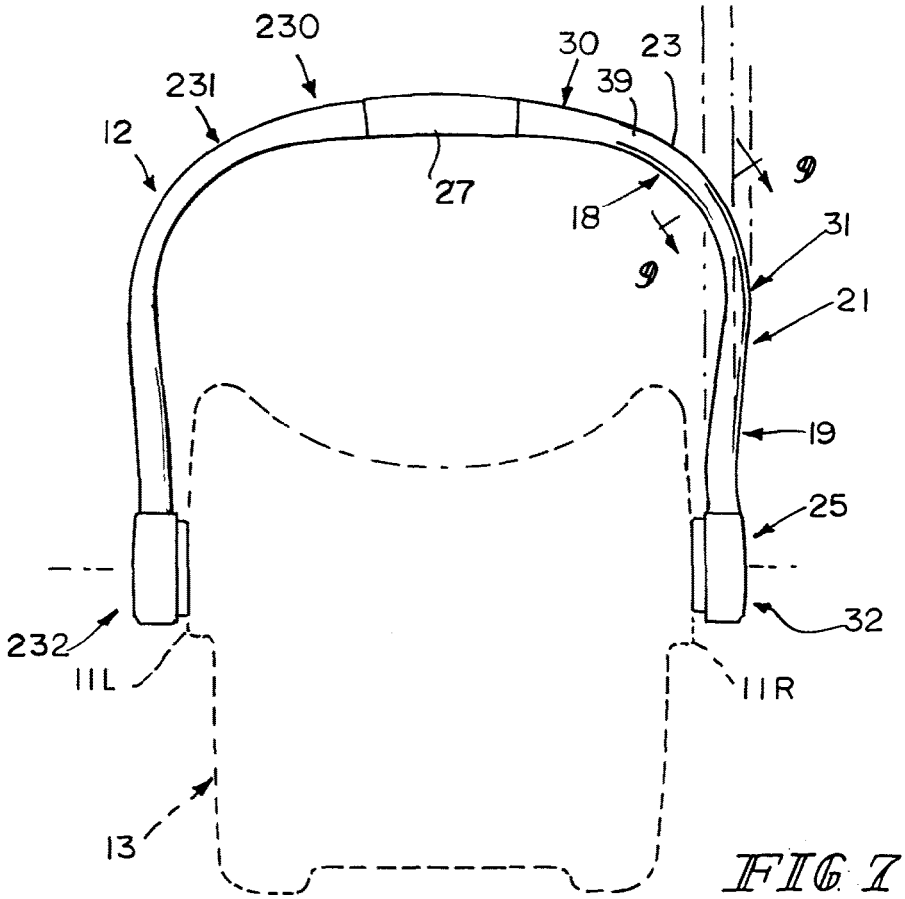
FIG. 7 is an enlarged front-elevation view of the infant carrier of FIG. 1 showing the shell in phantom and the carry handle in solid.

An infant carrier 10 in accordance with the present disclosure includes a carry handle 12 contoured to mate with the elbow 14 and hip 15 of a caregiver 16 carrying infant carrier 10 using an over-the-arm carrying technique as suggested in FIG. 1. An illustrative embodiment of carry handle 12 is shown in FIGS. 3 and 4. Illustrative radially inwardly and outwardly facing concave surfaces 18, 19 are provided on a first side arm 21 of the carry handle 10 as shown in FIGS. 5 and 6 and configured to match body contours of a caregiver using carry handle 12 in the manner shown in FIGS. 1 and 2. It is within the scope of this disclosure to establish each of the outwardly and inwardly facing concave surfaces disclosed herein using a series of arcuate sections having varying curvature radii to establish the concave character of each of the outwardly and inwardly facing concave surfaces.

Infant carrier 10 includes a shell 11 and a carry handle 12 as suggested in FIG. 1. Shell 11 is formed to include a basin 13 sized to hold an infant 17. Carry handle 12 is coupled to shell 11 as suggested in FIGS. 1, 2, 7, and 8.

Carry handle 12 includes a first side arm 21 coupled to one side 11R of shell 11, a second side arm 22 coupled to another side 11L of shell 11, and a bridge rail 20 as suggested in FIGS. 1, 3, and 4. Shell 11 includes a foot end 111 and a head end 112 as suggested, for example, in FIGS. 1 and 8. Bridge rail 20 is arranged to interconnect first and second side arms 21, 22 and lie above basin 13 as suggested in FIGS. 1 and 7. A grip handle 27 is coupled to bridge rail 20 as suggested in FIGS. 3, 4, and 7.

Figure 2:
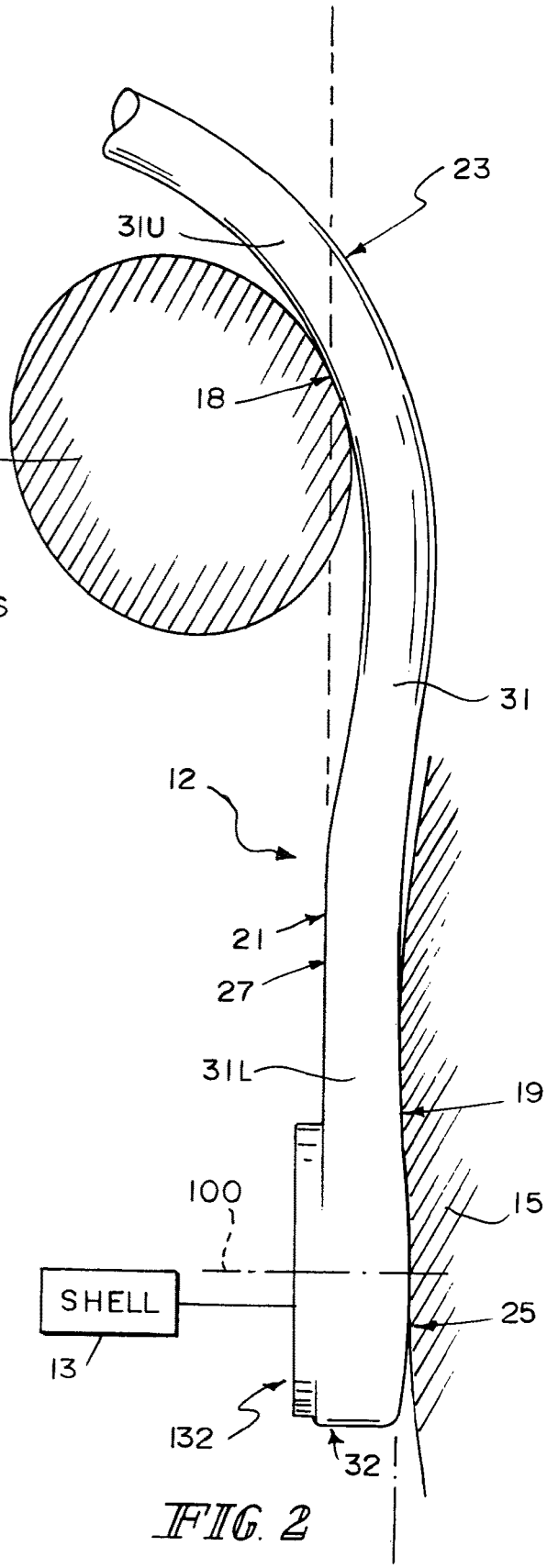
FIG. 2 is an enlarged front elevation view of a first side arm included in the carry handle of FIG. 1 showing an outwardly facing concave surface on a lower section of the first side arm mating with a hip region (shown in section) of the caregiver of FIG. 1 and showing an inwardly facing concave surface on a narrow upper section of the first side arm mating with an inner portion of the elbow of the caregiver of FIG. 1.
Figure 3:
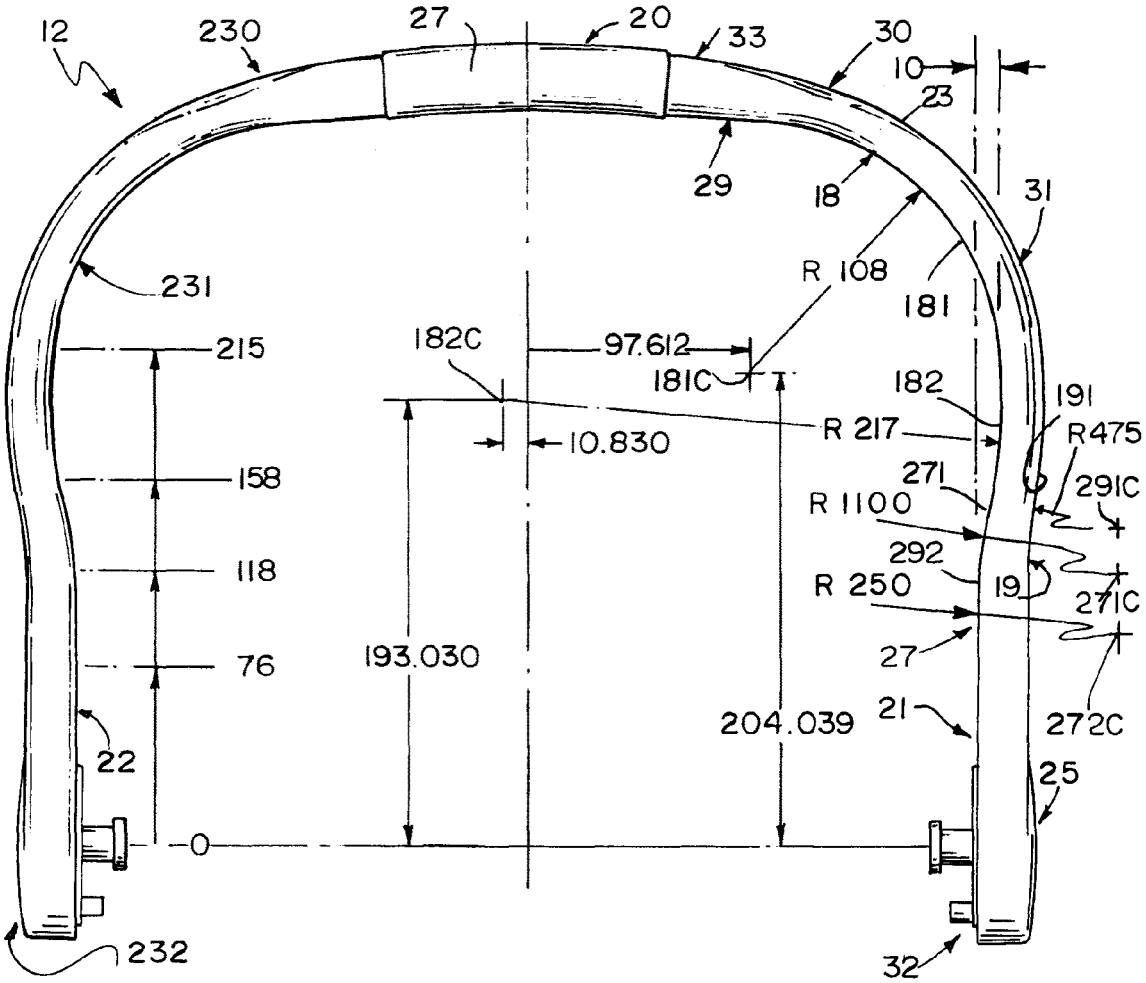
FIG. 3 is an enlarged scale front-elevation view of the carry handle of FIG. 1 separated from the shell and provided with dimensions measured in millimeters.

First side arm 21 includes an upper end 30 appended to bridge rail 20, a lower end 32 coupled to side 11R of shell 11, and a contoured segment 31 arranged to extend between upper and lower ends 30, 32 as suggested in FIGS. 2 and 3. Contoured segment 31 is shaped to mate with elbow 14 of a caregiver 16 as suggested in FIGS. 1 and 2.

Second side arm 22 includes a contoured segment 231 that has a contoured shape that is the mirror image of contoured segment 31 of first side arm 21. Second side arm 22 also includes an upper end 230 and a lower end 232 as suggested in FIGS. 3, 4, and 7.

Contoured segment 31 of first side arm 21 includes a lower section 31L and an upper section 31U arranged to lie between lower section 31L and upper end 30. Lower section 31L and upper section 31U are configured to fit a caregiver 16 carrying infant carrier 10 in the manner shown, for example, in FIG. 1. Contoured segment 231 of second side arm 22 is configured like contoured segment 31 of first side arm 22 to allow caregiver to carry infant carrier 10 over their left arm as well as over their right arm.

Lower section 31L of contoured segment 31 includes an outwardly facing concave surface 19 arranged to face away from shell 11. Outwardly facing concave surface 19 is configured to define hip means for mating with a hip region 15 of a caregiver 16 carrying shell 11 using carry handle 12 as suggested in FIGS. 1 and 2.

Upper section 31U of contoured segment 31 is relatively narrow as compared to lower section 31L as suggested in FIG. 2. Upper section 31U includes an inwardly facing concave surface 18 arranged to face toward shell 11 and configured to define elbow means for mating with an inner crook portion of an elbow 14 of caregiver 16 carrying shell 11 by holding carry handle 12 in that inner crook portion so that first side arm 21 of carry handle 12 is trapped between hip region 15 and the inner crook portion of elbow 14 of caregiver 16 as suggested in FIG. 1.

Inwardly facing concave surface 18 of upper section 31U of contoured segment 31 includes a first curved segment 181 having a first radius of curvature R108 of about 108 millimeters as suggested in FIGS. 3, 5, and 6. Inwardly facing concave surface 18 also includes a second curved segment 182 located between first curved segment 181 and outwardly facing concave surface 19 of lower section 31L as suggested in FIGS. 3, 5, and 6. Second curved segment 182 has a second radius of curvature R217 of about 217 millimeters as suggested in FIGS. 3, 5, and 6.

Outwardly facing concave surface 19 of lower section 31L of contoured segment 31 includes a curved segment 191 having a radius of curvature R475 of about 475 millimeters that is greater than first radius of curvature R108. Second radius of curvature R217 of second curved segment 182 is greater than first radius of curvature R108 but is less than radius of curvature R475 of curved segment 191 of outwardly facing concave surface 19.

Each of curved segments 181, 191 have arc lengths that are about equal to one another. Second curved segment 182 of inwardly facing concave surface 18 has an arc length of about s. First curved segment 181 of inwardly facing concave surface 18 has an arc length of about 2s.

First curved segment 181 of inwardly facing concave surface 18 has a first center of curvature 181C as suggested in FIGS. 3, 5, and 6 and having a location established by dimensions 97.612 (mm) and 204.039 (mm) shown in FIG. 3. Second curved segment 182 of inwardly facing concave surface 18 has a second center of curvature 182C having a location established by dimensions 10.830 (mm) and 193.030 (mm) shown in FIG. 3. Curved segment 191 of outwardly facing concave surface 19 has a third center of curvature 191C.

A first reference line 181RL is arranged to extend through first center of curvature 181C as suggested in FIG. 5. A second reference line 182RL is arranged to extend through second center of curvature 182C. A third reference line 191RL is arranged to extend through third center of curvature 191C and lie in spaced-apart parallel relation to each of first and second reference lines 181RL, 182RC. First and third reference lines 181RL, 191RL are separated by a distance D. Second and third reference lines 182RL, 191RL are separated by a distance d that is less than distance D.

Upper section 31U of contoured segment 31 further includes an outwardly facing convex surface 23 arranged to face away from inwardly facing concave surface 18 of upper section 31U. Lower end 32 includes an outwardly facing convex surface 25 arranged to face away from shell 11. Outwardly facing concave surface 19 of lower section 31L is arranged to lie between outwardly facing convex surfaces 23, 25 of upper section 31U and lower end 32 as suggested in FIG. 2.

Lower end 32 of first side arm 21 also includes a pivot mount 132 coupled to side 11L of shell 11. Pivot mount 132 is configured to support first side arm 21 for pivotable movement relative to shell 11 about a horizontal pivot axis 100 extending through pivot mount 132 included in second side arm 22. Pivot mount 132 includes outwardly facing convex surface 25 as suggested in FIG. 2.

Lower section 31L of contoured segment 31 also includes an inwardly facing convex surface 27 as suggested in FIG. 3. Inwardly facing convex surface 27 includes a first curved segment 271 having a radius of curvature R1100 of about 1100 millimeters (and a center of curvature 271C) and a second curved segment 272 having a radius of curvature of about 250 millimeters (and a center of curvature 272C).

Upper end 30 of first side arm 21 includes a first bulbous member 130 as suggested in FIGS. 3 and 4. First bulbous member 130 is arranged to interconnect bridge rail 20 and upper section 31U of contoured segment 31. First bulbous member 130 is formed to include an inwardly facing concave surface 29 facing toward basin 13 as suggested in FIG. 3. Inwardly facing concave surface 18 of upper section 30U of contoured segment 31 includes a first curved segment 181 coupled to first bulbous member 130. Inwardly facing concave surface 29 of first bulbous member 130 is formed to include a radius of curvature that is greater than radius of curvature RI 08 of first curved segment 181.

First bulbous member 130 has a maximum lateral width 130W as shown, for example, in FIG. 4. A portion of upper section 31U of contoured segment 31 that is appended to bulbous member 130 includes a maximum lateral width 31W that is less than maximum lateral width 130W of bulbous member 130 as suggested in FIG. 4.

Figure 8:
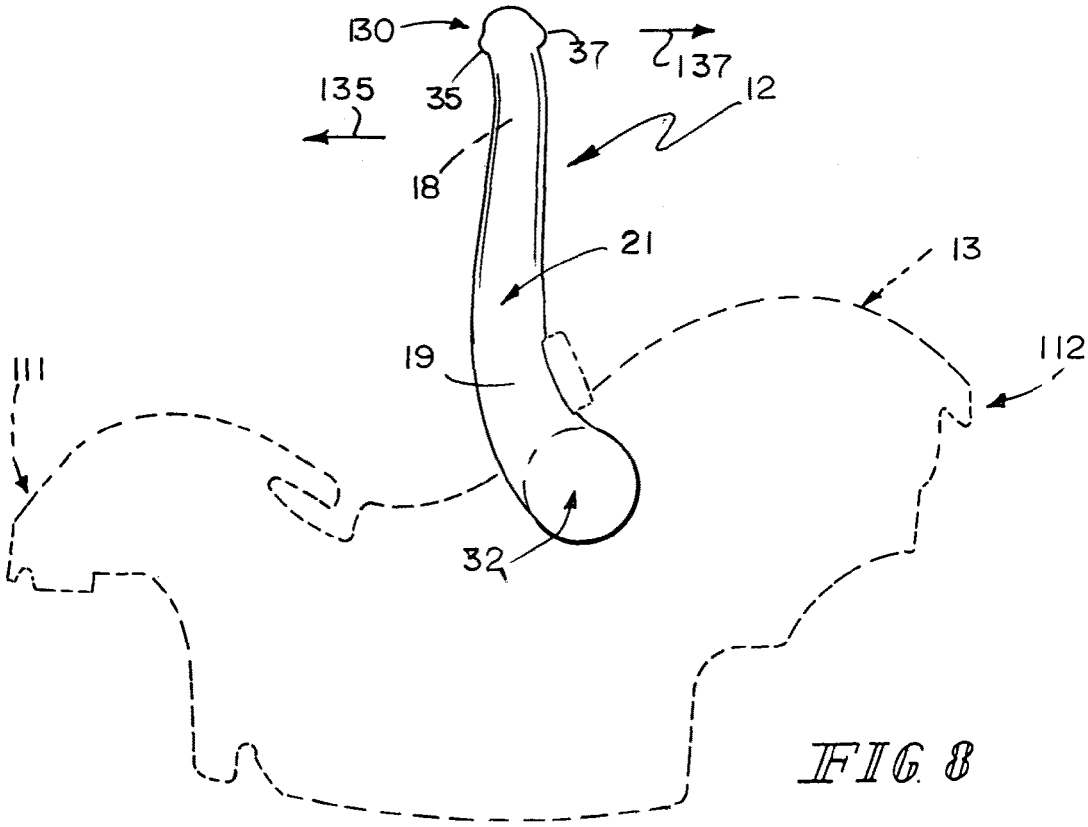
FIG. 8 is a side-elevation view of the infant carrier of FIG. 7.
Figure 10:
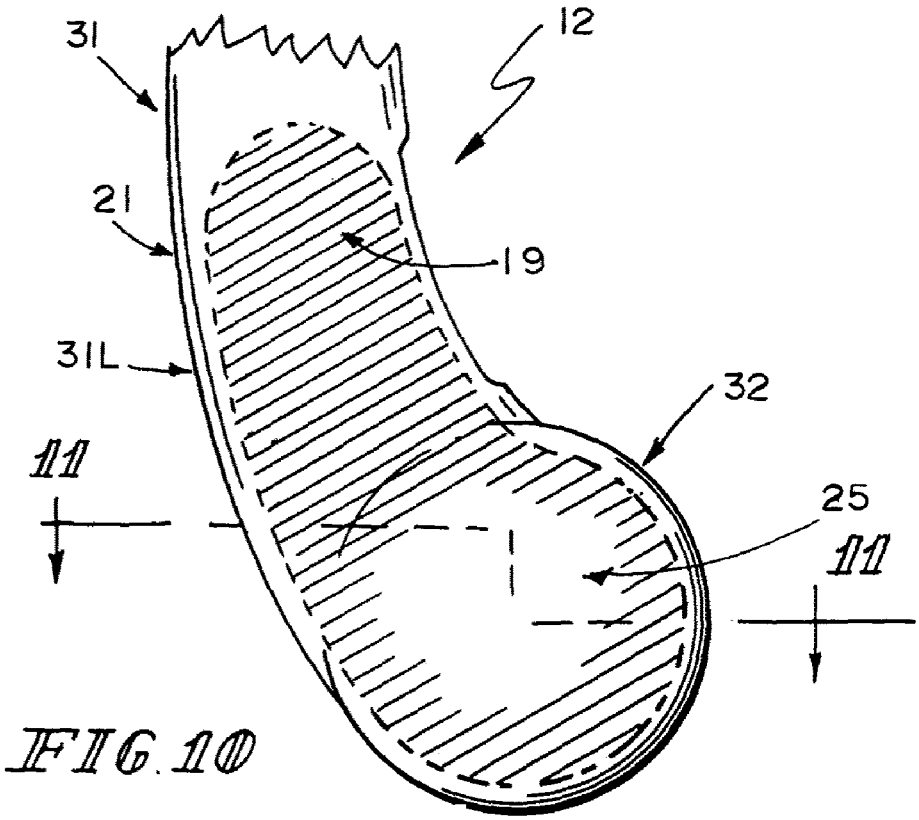
FIG. 10 is an enlarged portion of the right side arm of FIG. 8 showing that a body-contact zone (represented by a phantom, lined surface area) is provided on the pivot mount and a portion of the outwardly facing concave surface.
Figure 11:
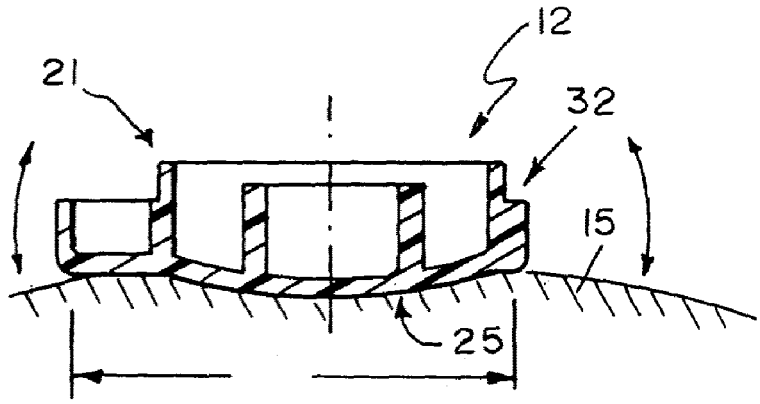
FIG. 11 is a section taken along line 11-11 of FIG. 10 showing mating engagement of the body-contact zone illustrated in FIG. 10 with a hip region of a caregiver holding the carry handle in the position shown in FIG. 1.

First bulbous member 130 is formed to include an outwardly facing convex surface 33 facing away from basin 13, a forward edge 35 facing in a forward direction 135, and a rearward edge 37 facing in an opposite rearward direction 137 as suggested in FIGS. 4 and 8. Forward edge 35 interconnects inwardly facing concave surface 29 of bulbous member 130 and outwardly facing convex surface 33 of bulbous member 130. Forward edge 37 has a convex shape bowed in forward direction 135. Rearward edge 37 interconnects inwardly facing concave surface 29 of bulbous member 130 and outwardly facing convex surface 33 of bulbous member 130.

Figure 9:
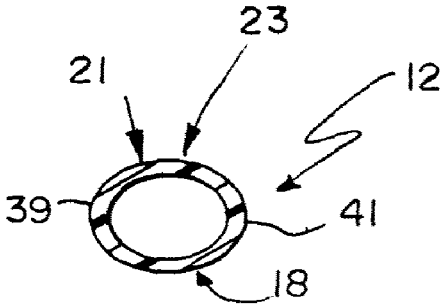
FIG. 9 is a sectional view taken along line 9-9 of FIG. 7 showing that a convex-shaped lower wall forms the outwardly facing concave surface of the upper section of the right side arm of the carry handle.

As suggested in FIG. 4, upper section 31U of contoured segment 3 further includes a forward edge 39 facing in forward direction 135 toward foot end 111 of shell 11, and a rearward edge 141 facing in opposite rearward direction 137 away from foot end 111 (and toward head end 112) of shell 11. Rearward edge 141 interconnects inwardly facing concave surface 18 of upper section 31U and outwardly facing convex surface 23 of upper section 31U as suggested in FIG. 9. Forward edge 39 of upper section 31U has a concave shape as shown in FIG. 4. Rearward edge 41 of upper section 31U has a concave shape as also shown in FIG. 4.

Forward edge 35 of first bulbous member 130 merges with forward edge 39 of upper section 130 as shown in FIG. 4.

Rearward edge 37 of first bulbous member 130 merges with rearward edge 41 of upper section 31U as also shown in FIG. 4.

First and second bulbous members 130 and 230 have the same size and shape in the illustrated embodiment as shown, for example, in FIG. 4. Various dimensional angles 81, 02, and 03 are shown in FIG. 4 wherein 01, is about 8°, 02 is about 7°, and 03 is about 3°. Forward edge 35 includes a first curved segment 351 having a radius of curvature R129 of about 129 millimeters and a second curved segment 352 having a radius of curvature of about 116 millimeters. Forward edge 39 includes a first curved segment 391 having a radius of curvature R56 of about 56 millimeters and a second curved segment 392 R105 of about 105 millimeters.

Various arc break points are shown (in millimeters) in FIG. 3 along second side arm 22. These same arc break points also apply to first side arm 22. Each arc is tangent to the adjacent arc.

The invention claimed is:

1. An infant carrier comprising:

a shell formed to include a basin sized to hold an infant and a carry handle coupled to the shell, wherein the carry handle includes a first side arm coupled to a first side of the shell, a second side arm coupled to a second side of the shell, and a bridge rail arranged to interconnect the first and second side arms and lie above the basin, the first side arm includes an upper end appended to the bridge rail, a lower end coupled to the first side of the shell, and a contoured segment arranged to extend between the upper and lower ends, and the contoured segment including a lower section and an upper section arranged to lie between the lower section and the upper end, and wherein the lower section includes an outwardly facing concave surface arranged to extend along a length of the handle between the contoured segment and the lower end and further arranged to face away from an outer surface of one of the sides of the shell and configured to define hip means for mating with a hip region of a caregiver carrying the shell using the carry handle, and the upper section includes an inwardly facing concave surface configured to define elbow means for mating with an inner crook portion of an elbow of the caregiver carrying the shell by holding the carry handle in that inner crook portion so that the first side arm of the carry handle is trapped between the hip region and the inner crook portion of the elbow of the caregiver.

2. The infant carrier of claim 1, wherein the inwardly facing concave surface includes a first curved segment having a first radius of curvature and the outwardly facing concave surface includes a curved segment having a radius of curvature that is greater than the first radius of curvature.

3. The infant carrier of claim 2, wherein each of the curved segment and the first curved segments have arc lengths that are about equal to one another.

4. The infant carrier of claim 2, wherein the inwardly facing concave surface also includes a second curved segment located between the first curved segment and the outwardly facing concave surface and the second curved segment has a second radius of curvature that is greater than the first radius of curvature but less than the radius of curvature of the curved segment of the outwardly facing concave surface.

5. The infant carrier of claim 4, wherein the second curved segment of the inwardly facing concave surface has an arc length of about s, the first curved segment of the inwardly facing concave surface has an arc length of about 2s, and the curved segment of the outwardly facing concave surface has an arc length of about 2s.

6. The infant carrier of claim 4, wherein the second curved segment of the inwardly facing concave surface has an arc length of about s and the curved segment of the outwardly facing concave surface has an arc length of about 2s.

7. The infant carrier of claim 4, wherein the first curved segment of the inwardly facing concave surface has a first center of curvature, the second curved segment of the inwardly facing concave surface has a second center of curvature, the curved segment of the outwardly facing concave surface has a third center of curvature, a first reference line is arranged to extend through the first center of curvature, a second reference line is arranged to extend through the second center of curvature, a third reference line is arranged to extend through the third center of curvature and lie in spaced-apart parallel relation to each of the first and second reference lines, the first and third lines are separated by a distance D, and the second and third lines are separated by a distance d that is less than distance D.

8. The infant carrier of claim 1, wherein the upper section of the contoured segment further includes an outwardly facing convex surface arranged to face away from the inwardly facing concave surface of the upper section, the lower end includes an outwardly facing convex surface arranged to face away from the shell, and the outwardly facing concave surface of the lower section is arranged to lie between the outwardly facing convex surfaces of the upper section and the lower end.

9. The infant carrier of claim 8, wherein the lower end of the first side arm includes a pivot mount coupled to the one side of the shell and configured to support the first side arm for pivotable movement relative to the shell about a horizontal pivot axis and the pivot mount includes the outwardly facing convex surface.

10. The infant carrier of claim 1, wherein the upper end of the first side arm includes a bulbous member arranged to interconnect the bridge rail and the upper section of the contoured segment, the bulbous member is formed to include an inwardly facing concave surface facing toward the basin and including a curved segment having a radius of curvature, the inwardly facing concave surface of the upper section of the contoured segment includes a first curved segment coupled to the bulbous member, the first curved segment has a first radius of curvature, and the curved segment of the bulbous member is formed to include a radius of curvature that is greater than the radius of curvature of the first curved segment.

11. The infant carrier of claim 10, wherein the bulbous member has a maximum lateral width and a portion of the upper section of the contoured segment that is appended to the bulbous member includes a maximum lateral width that is less than the maximum lateral width of the bulbous member.

12. The infant carrier of claim 10, wherein the bulbous member is formed to include an outwardly facing convex surface facing away from the basin, a forward edge facing in a forward direction and interconnecting the inwardly facing concave surface of the bulbous member and the outwardly facing convex surface of the bulbous member, and a rearward edge facing in an opposite rearward direction and interconnecting the inwardly facing concave surface of the bulbous member and the outwardly facing convex surface of the bulbous member, the forward edge has a convex shape bowed in the forward direction, and the rearward edge has a convex shape bowed in the opposite rearward direction.

13. The infant carrier of claim 12, wherein the upper section of the contoured segment further includes an outwardly facing convex surface arranged to face away from the inwardly facing convex surface of the upper section, a forward edge facing in the forward direction, a rearward edge facing in the opposite rearward direction, and interconnecting the inwardly facing concave surface of the upper section and the outwardly facing convex surface of the upper section, the forward edge of the upper section has a concave shape, and the rearward edge of the upper section has a concave shape.

14. The infant carrier of claim 13, wherein the forward edge of the bulbous member merges with the forward edge of the upper section and the rearward edge of the bulbous member merges with the rearward edge of the upper section.

15. The infant carrier of claim 1, wherein the upper end of the first side arm includes a bulbous member arranged to interconnect the bridge rail and the upper section of the contoured segment, the bulbous member has a maximum lateral width, and a portion of the upper section of the contoured segment that is appended to the bulbous member includes a maximum lateral width that is less than the maximum lateral width of the bulbous member.

16. The infant carrier of claim 15, wherein the bulbous member is formed to include an inwardly facing concave surface facing toward the basin, an outwardly facing convex surface facing away from the basin, a forward edge facing in a forward direction and interconnecting the inwardly facing concave surface of the bulbous member and the outwardly facing convex surface of the bulbous member, and a rearward edge facing in an opposite rearward direction and interconnecting the inwardly facing concave surface of the bulbous member and the outwardly facing convex surface of the bulbous member, the forward edge has a convex shape bowed in the forward direction, and the rearward edge has a convex shape bowed in the opposite rearward direction.

17. The infant carrier of claim 16, wherein the upper section of the contoured segment further includes an outwardly facing convex surface arranged to face away from the inwardly facing convex surface of the upper section, a forward edge facing in the forward direction, a rearward edge facing in the opposite rearward direction, and interconnecting the inwardly facing concave surface of the upper section and the outwardly facing convex surface of the upper section, the forward edge of the upper section has a concave shape, and the rearward edge of the upper section has a concave shape.

18. The infant carrier of claim 16, wherein the inwardly facing concave surface of the bulbous member and the outwardly facing concave surface of the bulbous member are separated by a thickness dimension t and the maximum lateral width of the bulbous portion is about 4t.

19. The infant carrier of claim 18, wherein the maximum lateral width of the portion of the upper section of the contoured segment is about 3t.

20. The infant carrier of claim 15, wherein the bulbous member is formed to include an inwardly facing concave surface facing toward the basin and an outwardly facing convex surface facing away from the basin and the inwardly facing concave surface of the bulbous member and the outwardly facing concave surface of the bulbous member are separated by a thickness dimension t and the maximum lateral width of the bulbous portion is about 4t.

21. The infant carrier of claim 20, wherein the maximum lateral width of the portion of the upper section of the contoured segment is about 3t.

22. An infant carrier comprising:

a shell formed to include a basin sized to hold an infant and a carry handle coupled to the shell, wherein the carry handle is U-shaped and includes, in series, a first pivot mount coupled to a first side of the shell, a first contoured segment, a first bulbous member, a bridge rail providing a hand grip, a second bulbous member, a second contoured segment arranged to lie in spaced-apart relation to the first contoured segment to locate the basin therebetween, and a second pivot mount coupled to an opposite second side of the shell and arranged to lie in spaced-apart relation to the first side of the shell to locate the basin therebetween, and wherein the carry handle includes a forward edge facing in a forward direction toward a foot end of the shell and a rearward edge facing in an opposition rearward direction toward an opposite head end of the shell, the forward and rearward edges of the bridge rail are separated by a maximum lateral width, the forward and rearward edges of each of the first and second bulbous portions are separated by a maximum width that is greater than the maximum width of the bridge rail, the first contoured segment includes an upper section appended to the first bulbous member, the forward and rearward edges of the upper section of the first contoured segment are separated by a maximum width that is less than the maximum width of the first bulbous portion, the second contoured segment includes an upper section appended to the second bulbous member, and the forward and rearward edges of the upper section of the second contoured segment are separated by a maximum lateral width that is less than the maximum lateral width of the second bulbous member, and wherein the carry handle has a lower section that includes an outwardly facing concave surface arranged to extend along a length of the handle between the contoured segment and the lower end and further arranged to face away from an outer surface of one of the sides of the shell.

* * * * *